US008353263B2

(12) United States Patent
Kinouchi et al.

(10) Patent No.: US 8,353,263 B2
(45) Date of Patent: Jan. 15, 2013

(54) VALVE TIMING ADJUSTER

(75) Inventors: Soichi Kinouchi, Kariya (JP); Tadao Ikihara, Okazaki (JP)

(73) Assignee: Denso Corporation, Kariya (JP)

( * ) Notice: Subject to any disclaimer, the term of this patent is extended or adjusted under 35 U.S.C. 154(b) by 315 days.

(21) Appl. No.: 12/913,039

(22) Filed: Oct. 27, 2010

(65) Prior Publication Data

US 2011/0107991 A1 May 12, 2011

(30) Foreign Application Priority Data

Nov. 9, 2009 (JP) ..... 2009-256069

(51) Int. Cl.
*F01L 1/34* (2006.01)
*F01M 9/10* (2006.01)

(52) U.S. Cl. ..... 123/90.15; 123/90.17; 123/90.37

(58) Field of Classification Search ..... 123/90.15, 123/90.17, 90.37, 90.41; 92/120–125
See application file for complete search history.

(56) References Cited

U.S. PATENT DOCUMENTS

| | | | |
|---|---|---|---|
| 6,311,654 | B1 | 11/2001 | Ushida et al. |
| 6,457,447 | B1 | 10/2002 | Sato et al. |
| 2001/0039933 | A1 | 11/2001 | Sato et al. |
| 2002/0050258 | A1 | 5/2002 | Sato et al. |

FOREIGN PATENT DOCUMENTS

| | | | |
|---|---|---|---|
| JP | 09-112223 | | 4/1997 |
| JP | 9-112223 | | 4/1997 |
| JP | 11-62524 | | 3/1999 |
| JP | 11-081925 | | 3/1999 |
| JP | P2000-104510 | A | 4/2000 |
| JP | P2000-179314 | A | 6/2000 |
| JP | P2003-113702 | A | 4/2003 |

*Primary Examiner* — Thomas Denion
*Assistant Examiner* — Steven D Shipe
(74) *Attorney, Agent, or Firm* — Nixon & Vanderhye PC

(57) ABSTRACT

A valve timing adjuster includes a housing member, a vane rotor, and a seal plate. A first housing segment of the housing member receives the vane rotor therein. A second housing segment of the housing member faces with an opening of the first housing segment. The seal plate includes a base part and a resilient part. The base part is held by the first and second housing segments therebetween. The resilient part is in press-contact with the end surface of the vane rotor within a predetermined angular range. The resilient part, the second housing segment, and a camshaft define therebetween a pressure chamber. The resilient part has a pressurized oil introduction passage that provides communication between the pressure chamber and only one of advance and retard hydraulic chambers.

4 Claims, 8 Drawing Sheets

VALVE TIMING ADJUSTER

CROSS REFERENCE TO RELATED APPLICATION

This application is based on and incorporates herein by reference Japanese Patent Application No. 2009-256069 filed on Nov. 9, 2009.

BACKGROUND OF THE INVENTION

1. Field of the Invention

The present invention relates to valve timing adjuster that adjusts valve timing of opening and closing at least one of an intake valve and an exhaust valve.

2. Description of Related Art

A conventional vane-type valve timing adjuster is known to drive a camshaft in order to open and close at least one of an intake valve and an exhaust valve of an internal combustion engine. More specifically, the conventional valve timing adjuster drives the camshaft by using the drive force obtained through a timing pulley or a chain sprocket that is rotatable synchronously with a crankshaft of the engine. Also, the conventional valve timing adjuster opens and closes the valve based on a rotational phase difference between (a) the camshaft and (b) the timing pulley or the chain sprocket.

In the above conventional vane-type valve timing adjuster, a vane rotor having vanes slides on longitudinal end surfaces of a housing member that rotationally receives therein the vane rotor. Thus, it is required to provide a slide clearance between the vane rotor and the housing member. The slide clearance is designed to be very small. However, it is impossible to sufficiently prevent pressurized oil in the hydraulic chamber from leaking through the slide clearance.

The slide clearance includes a radial clearance and a thrust clearance, for example. The radial clearance is defined between the vane rotor outer periphery and the housing member inner periphery. The thrust clearance is defined between the axial end surface of the vane rotor and the axial end surface of the housing member. In the present specification, the thrust clearance is focused on as the slide clearance. It should be noted that the leakage through the radial clearance has already been addressed by components, such as a conventional "seal member 7" and a conventional "leaf spring 8", as shown in the embodiments of the present invention.

In the present specification, leakage (or unwanted communication) of pressurized oil between an advance hydraulic chamber and a retard hydraulic chamber is referred to as "internal leakage". When the internal leakage occurs, pressurized oil supplied by an oil pump for valve timing adjustment is not effectively utilized. Thereby, energy efficiency of the oil pump may degrade disadvantageously, and also accuracy of a phase control through the adjustment of the valve opening/closing timing may also deteriorate disadvantageously.

In order to deal with the above disadvantages, in the invention disclosed by JP3567551 or JP-A-H11-62524, a sealing sheet is provided between the vane rotor and the gear, and the sealing sheet has a projecting resilient part. Thus, it is possible to prevent leakage of pressurized oil from the hydraulic chamber.

FIGS. 9A and 9B show a sealing sheet 150 described in JP-A-H11-62524. The sealing sheet 150 includes a fitting hole 152, through holes 151, and a pressurized oil introduction passage 153. The fitting hole 152 is fitted with the end portion of the camshaft. The through holes 151 are used for positioning the sealing sheet 150 in the circumferential direction. The pressurized oil introduction passage 153 is configured to introduce pressurized oil from one of the advance hydraulic chambers to the back side of the sealing sheet 150. Also, a resilient part 155 that is a disc spring is formed around a radially innermost part 154 of the sealing sheet 150. When the sealing sheet 150 is provided between the vane rotor and the gear, the resilient part 155 is bent, and the sealing sheet 150 contacts the vanes of the vane rotor. Furthermore, when pressurized oil is introduced to the back side of the sealing sheet 150 through the pressurized oil introduction passage 153, a differential pressure across the sealing sheet 150 is generated. Thus, the differential pressure urges the sealing sheet 150 toward the vane from the back side in order to prevent leakage of pressurized oil through the slide clearance.

In the present specification, sealing performance for limiting the "internal leakage" is referred to as "internal leakage sealing performance".

The sealing sheet 150 described in JP-A-H11-62524 has the resilient part 155 provided only around the radially innermost part 154. Thus, the above sealing sheet 150 is capable of applying the resilient force only to the narrow area. Also, the differential pressure is applied only to the narrow area. As a result, it is impossible to obtain sufficient "internal leakage sealing performance" disadvantageously. Also, because load of the resilient force is concentrated on a particular local spot of the sealing sheet 150, durability of the sealing sheet 150 may become insufficient.

The "sealing sheet 150" described in JP-A-H11-62524 corresponds to a "seal plate" in the present invention.

SUMMARY OF THE INVENTION

The present invention is made in view of the above disadvantages. Thus, it is an objective of the present invention to address at least one of the above disadvantages.

To achieve the objective of the present invention, there is provided a valve timing adjuster mounted to a driving force transmission system that transmits driving force from a drive shaft to a driven shaft, the valve timing adjuster including a housing member, a vane rotor, and a seal plate. The housing member is rotatable synchronously with one of the drive shaft and the driven shaft. The vane rotor is rotatable synchronously with a camshaft, which is the other one of the drive shaft and the driven shaft, and which opens and closes at least one of an intake valve and an exhaust valve. The vane rotor includes a plurality of vane parts, each of which is movable rotatably relative to the housing member within a predetermined angular range. Each of the plurality of vane parts defines an advance hydraulic chamber on one rotational side of each of the plurality of the vane parts. Each of the plurality of vane parts defines a retard hydraulic chamber on the other rotational side of each of the plurality of the vane parts. The housing member includes a first housing segment and a second housing segment. The first housing segment receives the vane rotor therein. The second housing segment faces with an opening of the first housing segment, and the second housing segment covers an end surface of the vane rotor. The seal plate is provided between the end surface of the vane rotor and the second housing segment, and the seal plate is held by the first housing segment and the second housing segment therebetween. The seal plate includes a base part and a resilient part. The base part is held by the first housing segment and the second housing segment therebetween. The resilient part is in press-contact with the end surface of the vane rotor within a range that corresponds to the predetermined angular range. The resilient part, an end surface of the second housing segment, and an outer peripheral surface of the camshaft define therebetween a pressure chamber. The resilient part has a pressurized oil introduction passage that provides communication between the pressure chamber and only one of the advance hydraulic chamber and the retard hydraulic chamber.

To achieve the objective of the present invention, there is also provided a valve timing adjuster mounted to a driving force transmission system that transmits driving force from a drive shaft to a driven shaft in order to open and close at least one of an intake valve and an exhaust valve, the valve timing adjuster including a housing member, a vane rotor, and a seal plate. The housing member is rotatable synchronously with one of the drive shaft and the driven shaft, wherein the housing member includes a first housing segment and a second housing segment. The first housing segment has a tubular shape with a bottom part, and the second housing segment faces with an opening of the first housing segment. The vane rotor is received within the first housing segment to define an internal space therebetween. The vane rotor is rotatable relative to the housing member within a predetermined angular range synchronously with the other one of the drive shaft and the driven shaft. The vane rotor includes a vane part that divides the internal space into an advance hydraulic chamber and a retard hydraulic chamber, which are arranged one after another in a rotational direction of the vane rotor. The seal plate is provided between the vane rotor and the second housing segment in an axial direction of the vane rotor. The seal plate includes a base part and a resilient part. The base part is held by the first housing segment and the second housing segment therebetween. The resilient part is in press-contact with an axial end surface of the vane part of the vane rotor that is located within the predetermined angular range. The resilient part, an end surface of the second housing segment, and an outer peripheral surface of the other one of the drive shaft and the driven shaft define therebetween a pressure chamber. The resilient part has a pressurized oil introduction passage that provides communication between the pressure chamber and only one of the advance hydraulic chamber and the retard hydraulic chamber. The base part has a positioning hole that positions the seal plate relative to the first and second housing segments.

BRIEF DESCRIPTION OF THE DRAWINGS

The invention, together with additional objectives, features and advantages thereof, will be best understood from the following description, the appended claims and the accompanying drawings in which:

Figure 1:
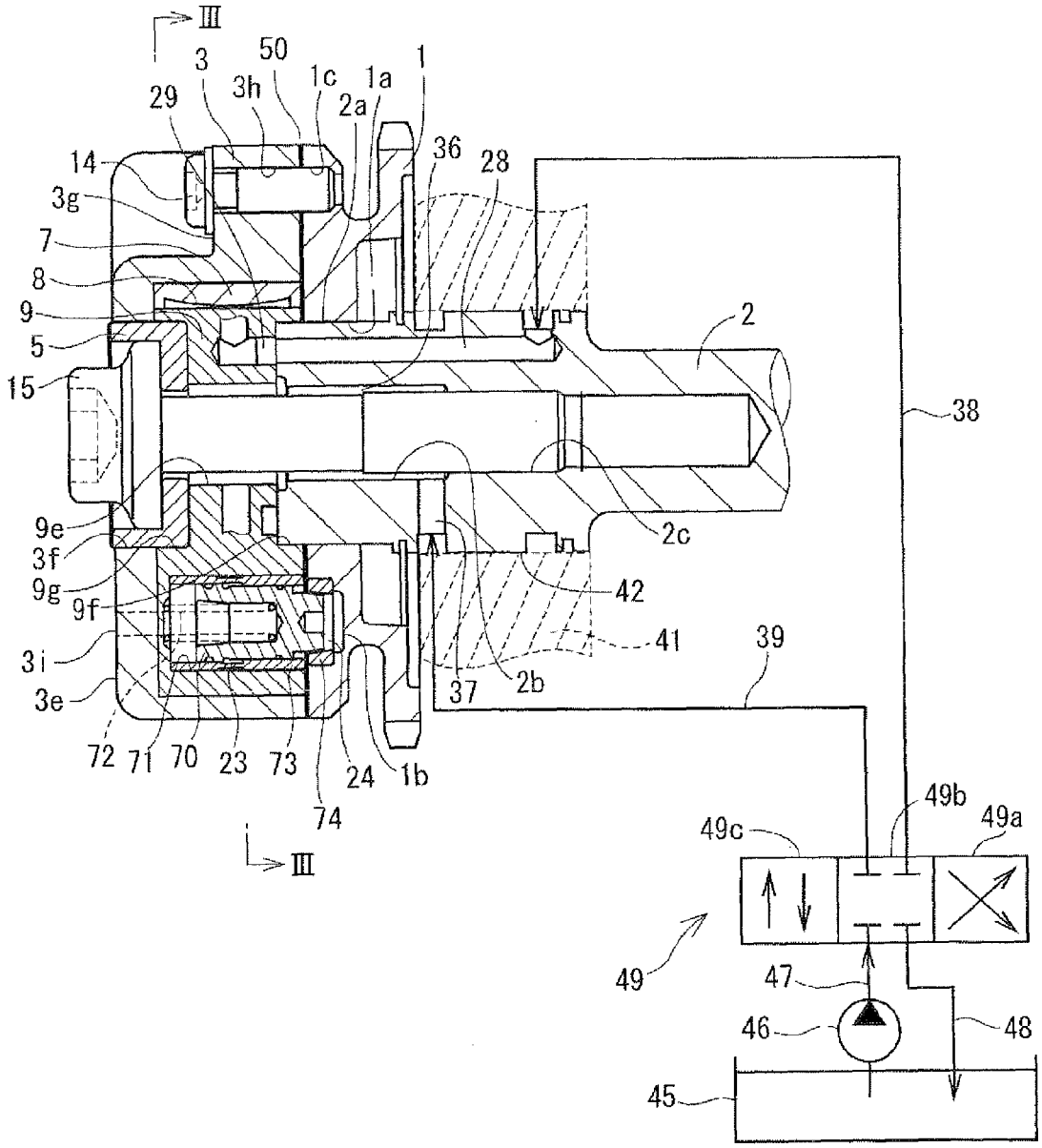
FIG. 1 is a cross-sectional view illustrating a valve timing adjuster of the first embodiment of the present invention.
Figure 2:
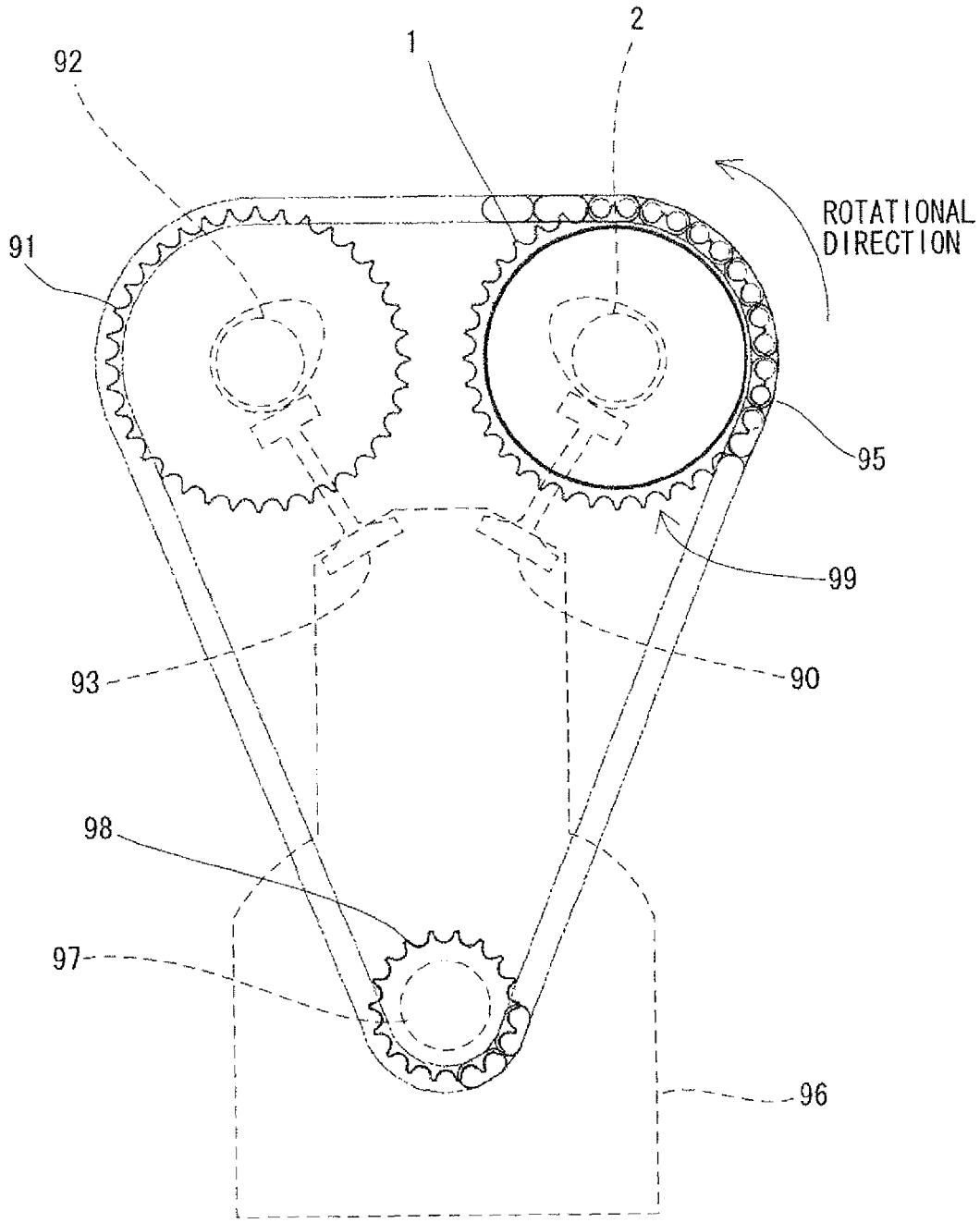
FIG. 2 is a schematic diagram illustrating an internal combustion engine provided with the valve timing adjuster of the first embodiment.

DETAILED DESCRIPTION OF PREFERRED EMBODIMENTS (First Embodiment)

The first embodiment of the present invention will be described with reference to FIGS. 1 to 7.

An internal combustion engine 96 has a crankshaft 97, a camshaft 2 for an intake valve 90, and a camshaft 92 for an exhaust valve 93. The crankshaft 97 corresponds to a "drive shaft", and at least one of the camshaft 2 and the camshaft 92 corresponds to a "driven shaft". The crankshaft 97 has a gear 98 that is coaxially fixed to the crankshaft 97. The camshaft 2 has a gear 1 that is coaxially fixed to the camshaft 2, and the camshaft 92 has a gear 91 that is coaxially fixed to the camshaft 92. The gear 98, the gear 1, and the gear 91 are engaged with a chain 95, and thereby driving force of the crankshaft 97 is transmitted to the gear 1 and the gear 91. As a result, the gear 1 and the gear 91 are rotatable synchronously with the crankshaft 97 (or the gear 98). The camshaft 2 opens and closes the intake valve 90, and the camshaft 92 opens and closes the exhaust valve 93.

A valve timing adjuster 99 of the first embodiment of the present invention is employed for the intake valve 90 and opens and closes the intake valve 90 by a predetermined phase difference relative to the crankshaft 97 and the gear 1.

Figure 3:
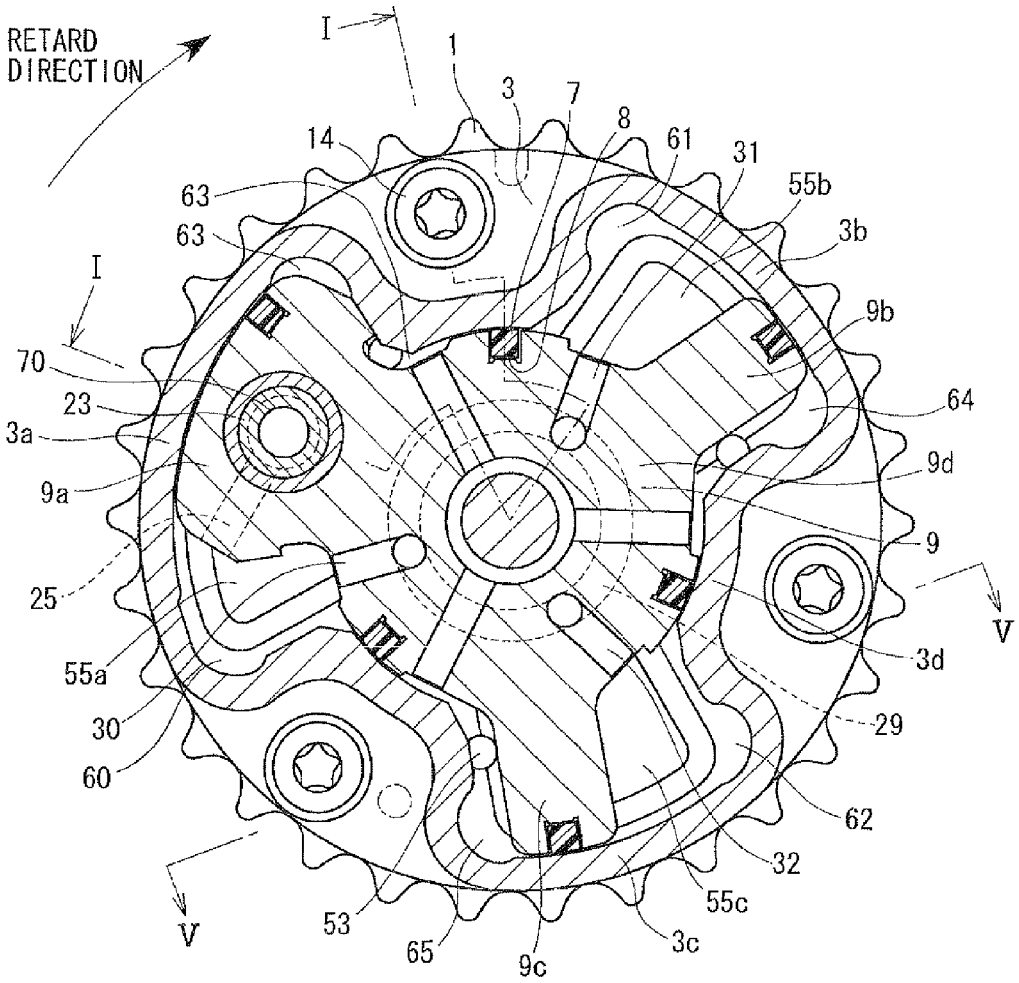
FIG. 3 is a cross-sectional view taken along line in III-III FIG. 1 for illustrating a full retard position of the valve timing adjuster according to the first embodiment.

FIG. 1 is a cross-sectional view illustrating the valve timing adjuster 99 of the first embodiment of the present invention and corresponds to a cross section taken along line I-I in FIG. 3. Also, FIG. 1 corresponds to a cross section taken along line I-I in FIG. 4 except for the illustration of a stopper pin 70.

FIG. 3 is a cross-sectional view illustrating a "full retard position", definition of which will be described later. As shown in FIG. 1, the stopper pin 70 is fitted with a stopper ring 74.

Figure 4:
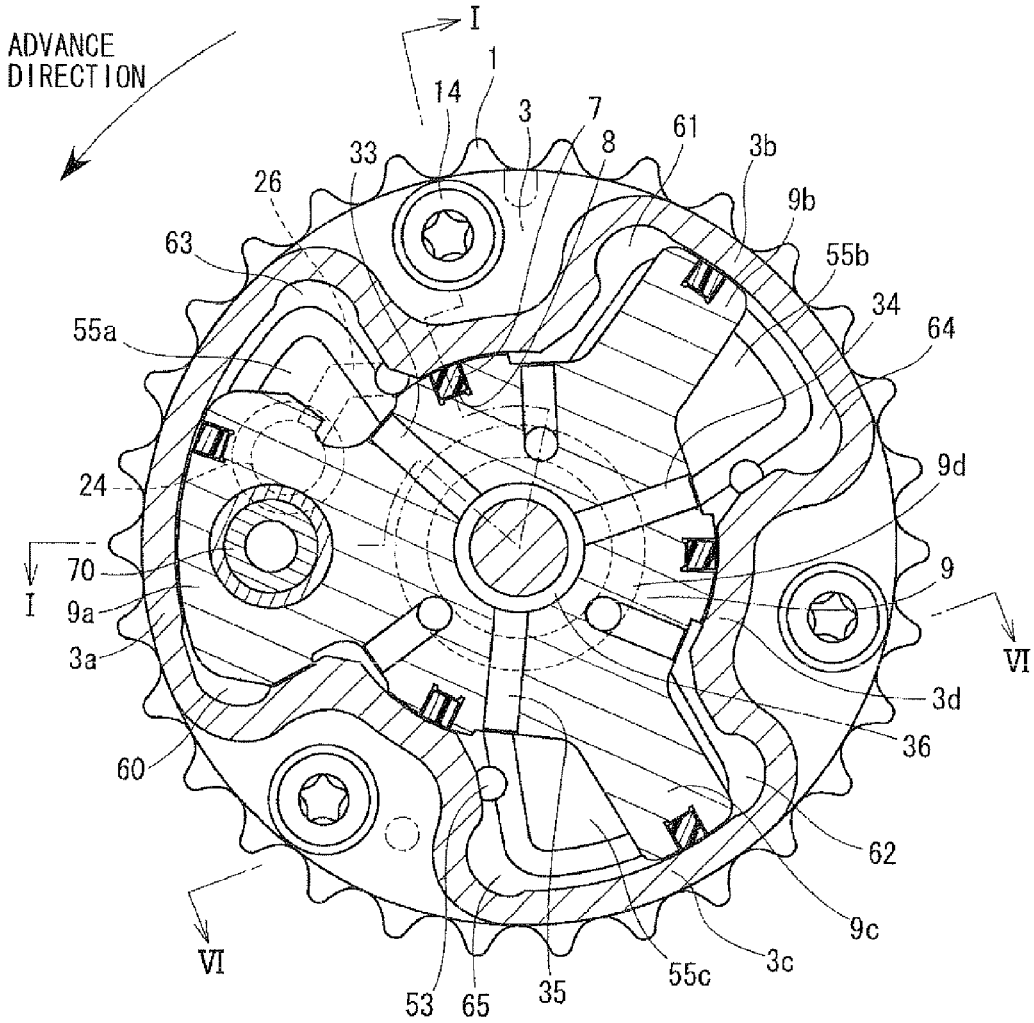
FIG. 4 is a cross-sectional view taken along line in III-III FIG. 1 for illustrating a full advance position of the valve timing adjuster according to the first embodiment.

FIG. 4 is a cross-sectional view illustrating a "full advance position", definition of which will be described later. FIG. 4 corresponds to a cross-sectional view taken along line III-III in FIG. 1 in a state, where the stopper pin 70 is retracted from (or disengaged from) the stopper ring 74.

In the present specification, "advancing" makes valve timing earlier, and "retarding" makes valve timing later. In the present embodiment, a counterclockwise direction in FIG. 3 and FIG. 4 corresponds to an "advance direction", and a clockwise direction corresponds to a "retard direction". Also, a side of an object in an advance direction is referred as an "advance side", and the other side of the object in the retard direction is referred as a "retard side".

In the present embodiment, a vane rotor 9 is "movable rotationally" relative to a shoe housing 3 within a "predetermined angular range". The term "being movable rotationally" indicates "being movable rotationally and coaxially" relative to the gear 1 and the shoe housing 3, both of which constitute a housing member. Also, the term "predetermined angular range" has limit positions that correspond to the "full advance position" and the "full retard position". Therefore, the vane rotor 9 is movable rotationally relative to the housing member in a range from the full retard position to the full advance position.

A configuration of the first embodiment will be described below.

The shoe housing 3 serves as a "first housing segment", and the gear 1 serves as a "second housing segment".

The gear 1 is movable rotationally based on the driving force transmitted from the crankshaft 97 serving as the "drive shaft". The gear 1 has a bearing hole 1*a* at a radial center of the gear 1, and the camshaft 2 serving as the "driven shaft" is fitted into the bearing hole 1*a*. Also, the gear 1 has a stopper ring hole 1*b* at a position that corresponds to the stopper pin 70 located at the full retard position. The stopper ring hole 1*b* has a bottom or is a blind hole. Also, the gear 1 has tap holes 1*c* that are threadably engaged with threaded members 14.

The shoe housing 3 has a tubular shape with a bottom and opens toward the gear 1. The shoe housing 3 has therein an internal space that is defined by a front part 3*e*, shoe parts 3*a*, 3*b*, 3*c*, and central wall parts 3*d*. The spaces defined by the shoe parts 3*a*, 3*b*, 3*c* extend radially outwardly from the central wall parts 3*d* in respective three directions. The inner wall of the front part 3*e* serves as the bottom surface of the shoe parts 3*a*, 3*b*, 3*c*.

Internal wall surfaces of the central wall parts 3*d* are formed between the shoe parts 3*a*, 3*b*, 3*c* in the circumferential direction. As shown in FIG. 3, the cross section of the internal wall surface of the central wall part 3*d* has an arc shape when the cross section is taken along a plane perpendicular to the axial direction of the shoe housing 3. The central wall parts 3*d* receive therein a rotor body part 9*d* of the vane rotor 9.

The shoe parts 3*a*, 3*b*, 3*c* has internal wall surfaces each having an arc-shape cross section. Also, each of the shoe parts 3*a*, 3*b*, 3*c* has an advance-side wall and a retard-side wall, which are coupled to the central wall parts 3*d*. Each of the shoe parts 3*a*, 3*b*, 3*c* receives therein a corresponding vane part 9*a*, 9*b*, 9*c* of the vane rotor 9. The vane part 9*a* has a width measured in a circumferential direction wider than a width of each of the vane part 9*b*, 9*c*. When the vane rotor 9 is located at the full retard position, a retard-side surface of the vane part 9*a* contacts a retard-side inner wall of the shoe part 3*a* as shown in FIG. 3. Also, when the vane rotor 9 is located at the full advance position, an advance-side surface of the vane part 9*a* contacts an advance-side inner wall of the shoe part 3*a* as shown in FIG. 4. In contrast, a retard-side surface and an advance-side surface of each of the vane parts 9*b*, 9*c* does not contact the corresponding inner wall of the shoe part 3*b*, 3*c* even when the vane rotor 9 is located at the full retard position or at the full advance position.

The front part 3*e* has a central hole 3*f* formed to extend therethrough at a radial center of the front part 3*e*. Also, three threaded member seats 3*g* are provided around the front part 3*e* between the shoe parts 3*a*, 3*b*, 3*c* in the circumferential direction. Each threaded member seat 3*g* has a threaded hole 3*h* that extends through the threaded member seat 3*g*.

The front part 3*e* has a ventilation hole 3*i* at a position corresponding to a position of the stopper pin 70 located at the full retard position. The ventilation hole 3*i* is communicated with atmosphere.

The gear 1 has positioning holes indicated by chain lines in FIGS. 3 and 4 at positions that correspond to positioning holes of the shoe housing 3 indicated by chain lines in FIGS. 3 and 4. Also, a seal plate 50, which will be described later, has a positioning notch 54*a* and a positioning hole 54*b* that are positioned correspondingly to the positions of the positioning holes of the gear 1 and the shoe housing 3.

The seal plate 50 is held between the gear 1 and the shoe housing 3 in a state, where the seal plate 50, the gear 1, and the shoe housing 3 are positioned by knock pins (not shown). Then, the three threaded members 14 extend through the threaded holes 3*h* such that the threaded members 14 are threaded to the tap holes 1*c*. As a result, the seal plate 50 the gear 1, and the shoe housing 3 are coaxially fastened to each other.

The vane rotor 9 includes the rotor body part 9*d* and the vane parts 9*a*, 9*b*, 9*c*. The rotor body part 9*d* is received within the central wall parts 3*d* of the shoe housing 3, and the vane parts 9*a*, 9*b*, 9*c* are received within the corresponding shoe parts 3*a*, 3*b*, 3*c*.

Seal members 7 are provided to an outer peripheral part of the rotor body part 9*d* and outer peripheral parts of the vane parts 9*a*, 9*b*, 9*c* such that the seal members 7 face with an inner peripheral wall surface of the shoe housing 3 as shown in FIG. 3. Each seal member 7 is urged by a respective leaf spring 8 toward the inner peripheral wall surface of the shoe housing 3 in order to prevent internal leakage through the clearances formed in the radial direction between the inner peripheral wall surface and the outer peripheral parts of the vane rotor 9.

Figure 8A:
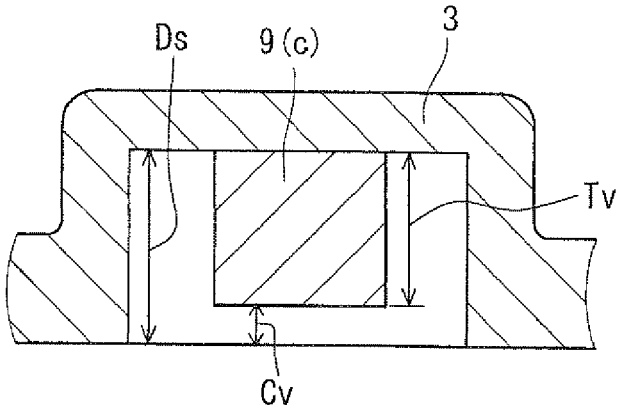
FIG. 8A is a sectional view illustrating dimensions of components.

The vane rotor 9 is precisely formed such that the axial end surfaces of the vane rotor 9 are parallel to each other and such that the thickness (axial dimension) of the vane rotor 9 is Tv. Also, a dimension Ds of the shoe parts 3*a*, 3*b*, 3*c* is measured in the axial direction from the opening end to the bottom part thereof as shown in FIG. 8A. Each shoe part 3*a*, 3*b*, 3*c* is formed precisely such that the bottom part of each shoe part 3*a*, 3*b*, 3*c* extends perpendicularly to the axial direction of the shoe housing 3. The difference between the dimension Ds and the thickness Tv is expressed as a slide clearance Cv by equation 1 as below.

$$Cv=Ds-Tv \quad \text{(equation 1)}$$

Also, the vane rotor 9 has a through hole 9*e* formed to extend through a radial center of the vane rotor 9. In the present embodiment, rightward in FIG. 1 corresponds to "rear side", and leftward in FIG. 1 corresponds to "front side". The through hole 9*e* has a rear socket joint 9*f* on a rear side of the through hole 9*e*, and has a front socket joint 9*g* on a front side of the through hole 9*e*. The rear socket joint 9*f* and front socket joint 9*g* are coaxially formed with each other with high precision.

An inner peripheral surface of the rear socket joint 9*f* is fitted with an outer peripheral surface of an end portion 2*a* of the camshaft 2. Also, a bottom surface of the rear socket joint 9*f* is flat with high precision, and the bottom surface is highly precisely orthogonal to a center axis of the vane rotor 9. Thus, the end surface of the camshaft 2 and the bottom surface of the rear socket joint 9*f* are in contact with each other with high precision, and thereby it is possible to prevent the leakage of oil through the surfaces in contact.

An inner peripheral surface of the front socket joint 9*g* is fitted with an outer peripheral surface of a center washer 5. Also, a bottom surface of the front socket joint 9*g* is flat with high, precision, and the bottom surface is highly precisely orthogonal to the center axis of the vane rotor 9. As a result, the end surface of the center washer 5 and the bottom surface of the front socket joint 9*g* are in contact with each other with high precision, and thereby it is possible to prevent the leakage of oil through the surfaces in contact.

The end surface of the camshaft 2 has an oil passage hole 2*b* at a radial center of the end surface, and the oil passage hole 2*b* is communicated with the through hole 9*e* of the vane rotor 9. A side surface of the oil passage hole 2*b* is communicated with an introduction oil passage 37. An introduction oil passage 28 is formed at a radially outer part of the end surface of the camshaft 2. The bottom portion of the oil passage hole 2*b* has a tap hole 2*c* that is threadably engageable with a center bolt 15.

The center washer 5 has a recess formed on a side of the center washer 5 remote from the vane rotor 9, and has a through hole formed at a radial center of the recess.

The center bolt 15 extends through the center washer 5, the through hole 9*e* of the vane rotor 9, and the oil passage hole 2*b* of the camshaft 2, and is fastened to the tap hole 2*c* by a predetermined fastening torque. In the above state, the center bolt 15 has a head seating surface that contacts a recessed bottom surface of the center washer 5, and friction between the seating surface and the bottom surface prevents the unfastening of the bolt 15. As a result, the camshaft 2 is coaxially fixed to the vane rotor 9.

In the above assembly, the camshaft 2 and the vane rotor 9 are movable rotationally relative to the gear 1 and the shoe housing 3. In other words, the camshaft 2 and the vane rotor 9 are movable rotationally relative to the "housing member". In the above configuration, the slide clearance Cv is defined between (a) an end surface of the vane rotor 9 adjacent to the gear 1 and (b) an end surface of the gear 1. In other words, the slide clearance Cv is defined between the opposing surfaces of the vane rotor 9 and the gear 1.

Next, configurations for hydraulic operation and internal leakage sealing will be described below. As shown in FIGS. 3 and 4, there are formed three pairs of a retard hydraulic chamber and an advance hydraulic chamber.

(a) A retard hydraulic chamber 60 is defined by the shoe part 3*a*, the vane part 9*a*, and the rotor body part 9*d*, and is located on an advance side of the vane part 9*a*. An advance hydraulic chamber 63 is also defined by the shoe part 3*a*, the vane part 9*a*, and the rotor body part 9*d*, and is located on a retard side of the vane part 9*a*.

(b) A retard hydraulic chamber 61 is defined by the shoe part 3*b*, the vane part 9*b* and the rotor body part 9*d*, and is located on an advance side of the vane part 9*b*. An advance hydraulic chamber 64 is also defined by the shoe part 3*b*, the vane part 9*b*, and the rotor body part 9*d*, and is located on a retard side of the vane part 9*b*.

(c) A retard hydraulic chamber 62 is defined by the shoe part 3*c*, the vane part 9*c*, and the rotor body part 9*d*, and is located on an advance side of the vane part 9*c*. An advance hydraulic chamber 65 is also defined by the shoe part 3*c*, the vane part 9*c*, and the rotor body part 9*d*, and is located on a retard side of the vane part 9*c*.

The retard hydraulic chambers 60, 61, 62 are generally separate from the respective advance hydraulic chambers 63, 64, 65 by the respective vane parts 9*a*, 9*b*, 9*c*, and the rotor body part 9*d*. However, more specifically, the adjacent hydraulic chambers may be communicated with each other through the slide clearance Cv formed between the end surface of the vane rotor 9 and the gear 1, and thereby internal leakage may occur. As a result, the efficiency of oil pump may degrade, and thereby deteriorating the accuracy of the phase control in the conventional art.

Thus, in the present embodiment, in order to prevent the above internal leakage, the seal plate 50 is held by (a) the gear 1 and (b) the end surface of the vane rotor 9 therebetween.

Figure 7:
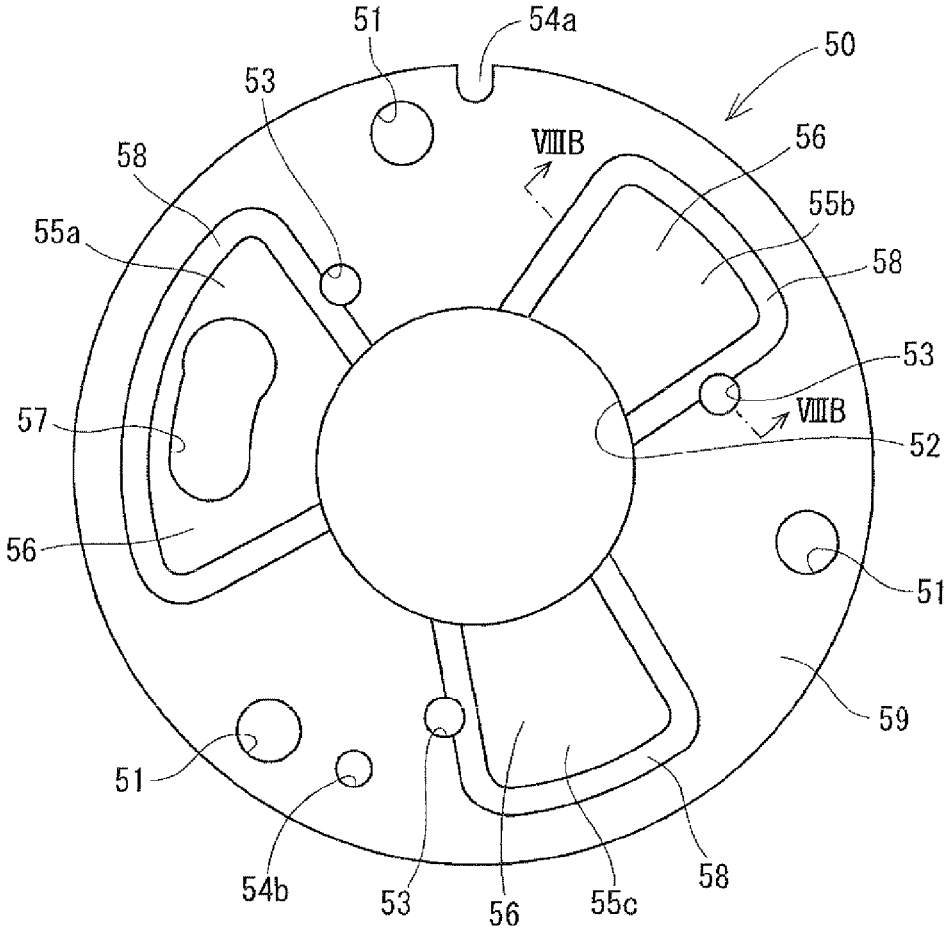
FIG. 7 is a plan view illustrating a seal plate according to the first embodiment.

FIG. 7 is a plan view of the seal plate 50 of the first embodiment observed in a direction from the left to the right in FIG. 1, FIG. 7 is the plan view observed in the direction similar to the observation direction of FIGS. 3 and 4. In FIGS. 3 and 4, a part of the seal plate 50 is shown behind the vane rotor 9.

The seal plate 50 has a fitting hole 52 located at a radial center of the seal plate 50, and the fitting hole 52 receives therein the end portion 2*a* of the camshaft 2. Also, the seal plate 50 has through holes 51, the positioning notch 54*a*, and the positioning hole 54*b* at positions correspondingly to the position of the gear 1 and the position of the shoe housing 3. The through holes 51 allows the threaded members 14 to extend therethrough, and the positioning notch 54*a* and the positioning hole 54*b* are used for accurately positioning the seal plate 50 in the rotational direction (circumferential direction). It should be noted that in the description of the seal plate 50 in the present embodiment, "each hole" or "positioning hole" includes the positioning notch 54*a*. The seal plate 50 uses each hole to be effectively held between the gear 1 and the shoe housing 3.

The seal plate 50 has a base part 59 and resilient parts 55*a*, 55*b*, 55*c*. The resilient parts 55*a*, 55*b*, 55*c* are provided at positioned radially outward of the fitting hole 52 correspondingly to the ranges, in which the vane parts 9*a*, 9*b*, 9*c* are rotationally movable. Each of the resilient parts 55*a*, 55*b*, 55*c* has a generally fan shape and projects from the base part 59 toward the vane rotor 9 in a direction from the right to the left in FIG. 1. In FIG. 7, each of the resilient parts 55*a*, 55*b*, 55*c* projects in a direction from the back side to the front side of FIG. 7. In the present embodiment, the three resilient parts 55*a*, 55*b*, 55*c* are referred to as a "resilient part 55" in order to facilitate the description. Each hole is formed on the base part 59. In other words, the base part 59 is a part other than the resilient part 55 and each hole.

Figure 5:
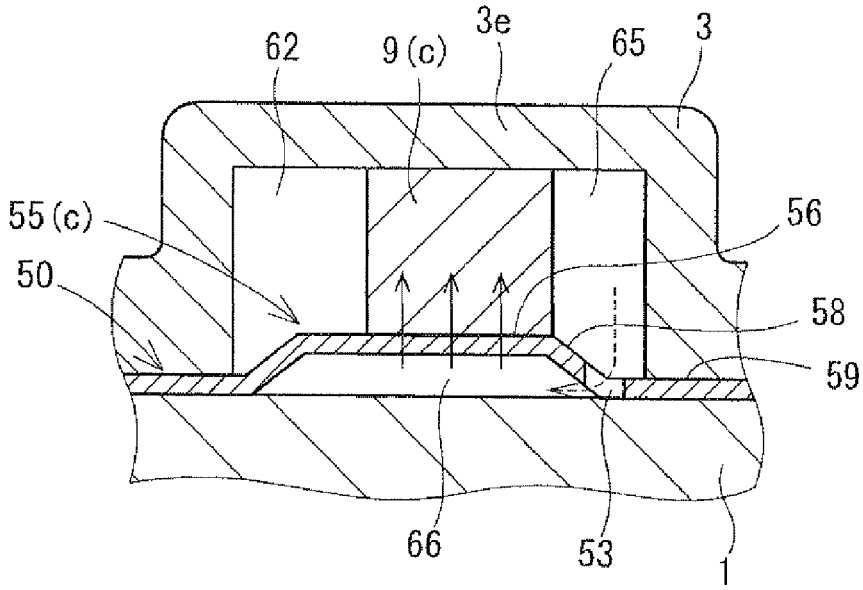
FIG. 5 is an enlarged sectional view taken along line V-V in FIG. 3 for illustrating the full retard position.
Figure 6:
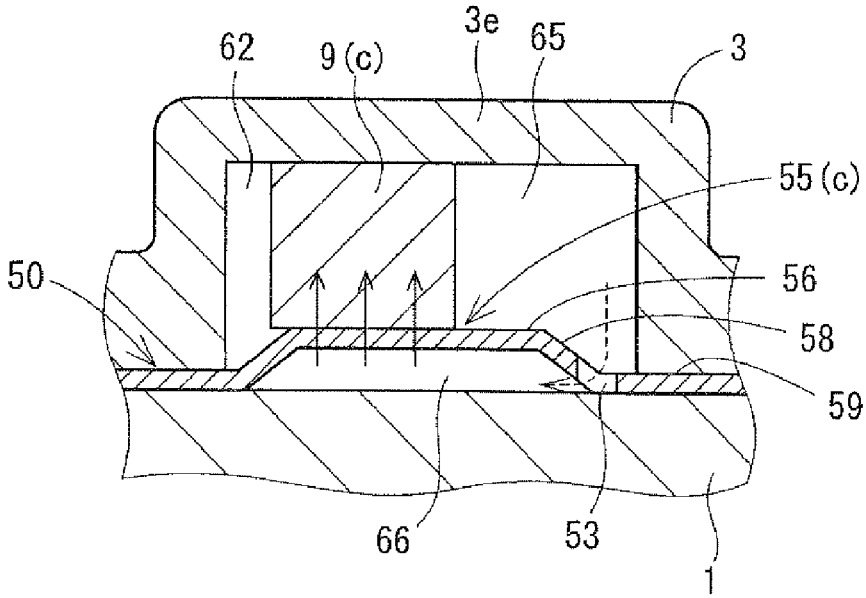
FIG. 6 is an enlarged sectional view taken along line VI-VI in FIG. 4 for illustrating the full advance position.

FIG. 5 is a cross section taken along line V-V of FIG. 3, and FIG. 6 is a cross section taken along line VI-VI of FIG. 4. FIGS. 5 and 6 are enlarged sectional views illustrating a part of the shoe part 3*c*, and the dimension of the seal plate 50 measured in a thick direction (a direction perpendicular to the plane of the seal plate 50) is exaggerated. FIGS. 5 and 6 represent the cross section of the shoe parts 3*a*, 3*b*.

Figure 8B:
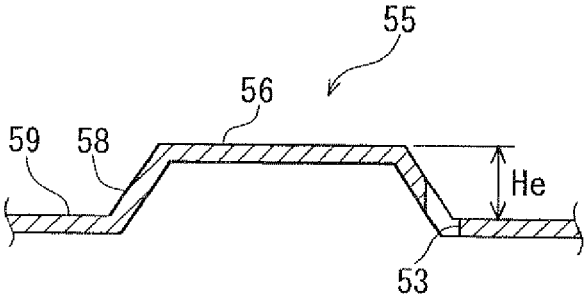
FIG. 8B is a sectional view of a resilient part of the seal plate taken along line VIII-VIII in FIG. 7.

The resilient part 55 includes an upper surface part 56 and a slanted part 58. The upper surface part 56 is flat and contacts the vane rotor 9 and is displaced from the base part 59 in the axial direction of the vane rotor 9 (or in the longitudinal direction of the camshaft 2) as shown in FIG. 8B. The slanted part 58 connects the base part 59 with the upper surface part 56, and is angled relative to the upper surface part 56 and the base part 59. The slanted part 58 is formed on a peripheral edge of the upper surface part 56 except for the edge segment that defines the fitting hole 52 as shown in FIG. 7. A pressure chamber 66 is defined by the resilient part 55, the end surface of the gear 1, and the outer peripheral surface of the end portion 2*a* of the camshaft 2.

Also, the upper surface part 56 of the resilient part 55*a* has a stopper pin hole 57 formed at a position that corresponds to a range, in which the stopper pin 70 is movable rotationally relative to the seal plate 50.

It should be noted that the term "flat" in the present embodiment indicates a surface that may have very small waves or very small scratches thereon in the acceptable level for substantial operation, and thereby the flat surface of the present embodiment is not limited to a "perfect" flat surface.

Figure 8C:
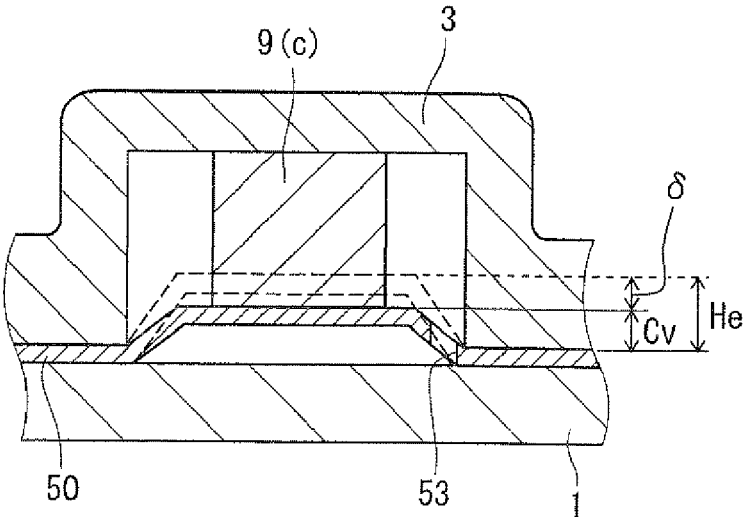
FIG. 8C is a sectional view illustrating deformation of the resilient part of the seal plate.

The difference between the plane of the base part 59 and the plane of the upper surface part 56 is measured in the axial direction of the seal plate 50 (the direction perpendicular to the plane of the seal plate 50), and is referred to as a "free height He" (see FIG. 8B). In FIG. 8C, the resilient part 55 before the assembly is shown by a dashed line, and the resilient part 55 after the assembly is shown by a solid line. The deformation of the resilient part 55 caused by the assembly is exaggerated in FIG. 8C. The free height He is designed to be slightly greater than the slide clearance Cv such that the resilient part 55 is compressed in contact with the vane rotor 9 when the resilient part 55 is assembled as shown in FIG. 8C. The difference between the free height He and the slide clearance Cv is expressed as a deformation δ in the following equation 2.

$$\delta = He - Cv > 0 \quad \text{(equation 2)}$$

Specifically, both of the free height He and the slide clearance Cv have the dimension of about 0.1 mm, and the dimension of the deformation δ is designed to have an order of magnitude of 0.01 mm. Because the deformation δ is greater than zero, the resilient force generates the sealing performance, and thereby it is possible to reduce the internal leakage between (a) the retard hydraulic chambers 60, 61, 62 and (b) the advance hydraulic chambers 63, 64, 65.

Also, the seal plate 50 is a sheet metal, and is perforated to form each hole through press work. Also, the seal plate 50 is processed to have the projected resilient parts 55 through press work. The boundary between the base part 59 and the upper surface part 56 does not form a sharp step. Rather, the slanted part 58 is angled relative to the plane of the base part 59 to gradually change the difference between the base part 59 and the upper surface part 56. As a result, it is possible to effectively prevent the generation of crack, and thereby improving the durability of the seal plate 50.

In addition, the seal plate 50 has pressurized oil introduction passages 53. As shown in FIG. 3, the pressurized oil introduction passages 53 are formed at positions such that the pressurized oil introduction passages 53 are communicated with the corresponding advance hydraulic chambers 63, 64, 65 when the vane rotor 9 is at the full retard position. In other words, the pressurized oil introduction passages 53 are formed at the retard ends of the resilient parts 55*a*, 55*b*, 55*c*. More specifically, as shown in FIGS. 5 and 6, each pressurized oil introduction passage 53 is formed to extend between the slanted part 58 and the base part 59. Thereby, pressurized oil in the advance hydraulic chambers 63, 64, 65 is introduced into the pressure chambers 66 through the pressurized oil introduction passages 53 at any rotational phase between the full retard position and the full advance position. It should be noted that the cross sectional shape of the pressurized oil introduction passages 53 is not limited to the circular shape, but the pressurized oil introduction passages 53 may be an elongated hole. Also, the single advance hydraulic chamber may alternatively have two or more pressurized oil introduction passages 53.

In the present embodiment, as above, the pressurized oil introduction passage 53 has at least a part that is provided to the slanted part 58. In other words, the slanted part 58 has the pressurized oil introduction passage 58.

As a result, it is possible to provide the pressurized oil introduction passage 53 at an optimum position. In order to introduce the pressurized oil into the pressure chamber 66, the pressurized oil introduction passage 53 has to be provided to the upper surface part 56 or the slanted part 58. For example, in an example case of providing the pressurized oil introduction passage 53 to the upper surface part 56 instead, the vane part may overlap the passage 53 and close the pressurized oil introduction passage 53 in a predetermined angular range, in which the vane part is movable rotationally. In order to prevent the above closure of the pressurized oil introduction passage 53 by the vane part, the area of the upper surface part has to be enlarged to provide enough area for the opening of the introduction passage 53. Thus, in order to avoid the above, the pressurized oil introduction passage 53 is provided to the slanted part 58 in the present embodiment.

The pressure chamber 66 is tightly defined by the resilient part 55, the end surface of the gear 1, and the outer peripheral surface of the camshaft 2. The pressure chamber 66 is communicated with the exterior only through the pressurized oil introduction passages 53. In other words. The pressure chamber 66 does not have any other passage that is communicated with other space except for the pressurized oil introduction passages 53. As above, the pressure chamber 66 is closed (or is tightly defined) by the resilient part 55, the end surface of the gear 1, and the outer peripheral surface of the camshaft 2. For example, in the present embodiment, the term "the pressure chamber 66 is tightly defined" indicates that the pressure chamber 66 is not provided with any passage that allows oil in the pressure chamber 66 to leak therethrough. In the above definition, the tightly defined pressure chamber 66 (or the closed pressure chamber 66) may have a very small hole that does not allow oil to leak therethrough. More specifically, the part of the end surface of the gear 1, which part defines the pressure chamber 66, is not provided with any holes and any grooves. As a result, pressurized oil once introduced into the pressure chamber 66 is limited from leaking to the other space, and thereby pressurized oil effectively exerts force pressing the resilient part 55 against the vane rotor 9. In the above, pressure of oil in the pressure chamber 66 is higher than pressure of oil in the retard hydraulic chambers 60, 61, 62 located on a side of the resilient part 55 opposite from the pressure chambers 66. As a result, there is a differential pressure generated across the resilient part 55. Because the resilient part 55 has the generally fan shape, the resilient part 55 has a large area defined by a large circumferential dimension and a large radial dimension as shown in FIG. 7. As a result, when the oil pressure of the pressure chamber 66 is applied to the large area of the resilient part 55, it is possible to generate a large pressing force load.

Figure 9A:
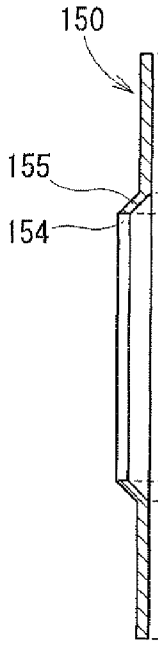
FIG. 9A PRIOR ART
FIG. 9A is a cross-sectional view of a conventional sealing sheet.
Figure 9B:
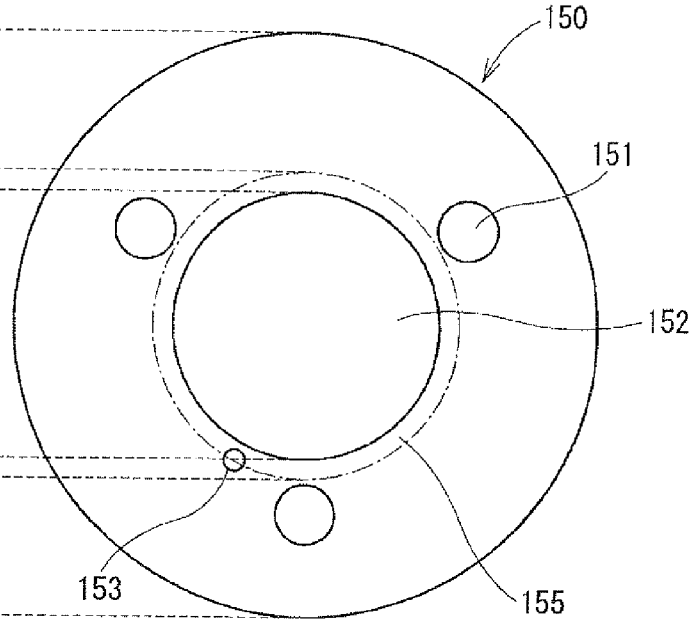
FIG. 9B PRIOR ART
FIG. 9B is a plan view of the conventional sealing sheet.

In a conventional technique shown in FIGS. 9A and 9B, resilient force of a sealing sheet 150 and a differential pressure across the sealing sheet 150 are used for pressing the sealing sheet 150 toward the vane rotor 9. The above resilient force and the differential pressure are applied to a narrow area around a radially innermost part 154 as shown in FIGS. 9A and 9B. As a result, an internal leakage sealing performance is not sufficiently achieved in the conventional art. Furthermore, load of resilient force is concentrated on a particular area in the conventional art, and thereby durability of the sealing sheet 150 may further deteriorate. In contrast, in the present embodiment, the resilient force and the differential pressure are applied to the wider area compared with the conventional art in order to press the seal plate 50 against the vane rotor 9. As a result, the internal leakage sealing performance is effectively improved. Also, because load of the resilient force is not concentrated on the particular local spot in the present embodiment, the durability of the seal plate 50 is effectively improved.

Next, configuration related to a stopper mechanism will be described. The stopper pin 70 is received within a receiving hole 71 that is provided on an end surface of the vane part 9*a* adjacent to the gear 1. The receiving hole 71 has a hole at a bottom of the receiving hole 71, and the hole is brought into communication with the ventilation hole 3*i* of the front part 3*e* when the vane rotor 9 is at the full retard position.

The stopper ring 74 is fitted into the stopper ring hole 1*b* of the gear 1. The stopper ring 74 has an inner peripheral surface that is tapered such that a diameter of the opening of the stopper ring 74 adjacent to the vane rotor 9 is larger than a diameter of the other end of the stopper ring 74. The outer peripheral surface of the end portion of the stopper pin 70 is also tapered by a taper angle similar to the taper angle of the inner peripheral surface of the stopper ring 74, and thereby the stopper pin 70 is easily fitted with the stopper ring 74.

There is provided a spring 72 between the bottom portion of the receiving hole 71 and the stopper pin 70, and the spring 72 urges the stopper pin 70 toward the stopper ring 74.

A guide bush 73 is fitted into the receiving hole 71 and receives the stopper pin 70 therein. The stopper pin 70 has an axial section of the outer peripheral surface that is fitted with a corresponding axial section of the inner peripheral surface of the guide bush 73 such that the guide bush 73 guides the displacement of the stopper pin 70 in the longitudinal direction.

The stopper pin 70 has a pressure receiving groove at a certain position in the longitudinal direction, and the pressure receiving groove and the inner peripheral surface of the guide bush 73 define therebetween a hydraulic chamber 23. Also, a side surface of the guide bush 73 is provided with a communication hole 25 (see FIG. 3) that introduces pressurized oil from a retard main oil passage 38 to the hydraulic chamber 23.

A hydraulic chamber 24 is defined by the end portion of the stopper pin 70, the stopper ring 74, and a bottom portion of the stopper ring hole 1*b*. Also, a communication hole 26 (see FIG. 4) is provided to introduce pressurized oil from an advance main oil passage 39 to the hydraulic chamber 24.

Due to the above configuration, when pressurized oil is introduced into the hydraulic chamber 23 or the hydraulic chamber 24, the stopper pin 70 is displaced toward the bottom portion of the receiving hole 71 against the biasing force of the spring 72, and thereby the stopper pin 70 is disengaged from the stopper ring 74. In other words, when pressurized oil is introduced into the hydraulic chamber 23 or the hydraulic chamber 24, the stopper pin 70 is displaced in a leftward in FIG. 1 such that the stopper pin 70 gets out of the stopper ring 74. In the above, air in the receiving hole 71 is released to the exterior through the ventilation hole 3*i*.

At the full retard position shown in FIG. 3, because the stopper pin 70 is fitted into the stopper ring 74, the vane rotor 9 is coupled with the gear 1, and thereby is rotatable with the gear 1. In other words, the vane rotor 9 and the gear 1 are not movable relative to each other when the vane rotor 9 is coupled with the gear 1.

When the stopper pin 70 is disengaged from the stopper ring 74, the vane rotor 9 is decoupled from the gear 1. As a result, the vane rotor 9 becomes capable of being movable rotationally relative to the gear 1 in the angular range from the full retard position to the full advance position.

Next, supply and discharge of pressured oil will be described.

An annular oil passage 29 is formed at a bottom surface of the rear socket joint 9*f* of the rotor body part 9*d*. The annular oil passage 29 contacts the end surface of the camshaft 2, and is communicated with the retard main oil passage 38 through the introduction oil passage 28 within the camshaft 2. Also, the annular oil passage 29 is communicated with retard distribution passages 30, 31, 32 within the rotor body part 9*d*. More specifically, the retard distribution passage 30 is communicated with the retard hydraulic chamber 60, the retard distribution passage 31 is communicated with the retard hydraulic chamber 61, and the retard distribution passage 32 is communicated with the retard hydraulic chamber 62.

It should be noted that alternative multiple oil passages may be formed in place of the single annular oil passage 29. For example, each of the alternative oil passages may provide communication between (a) the introduction oil passage 28 and (b) the respective retard distribution passage 30, 31, 32.

The through hole 9*e* of the vane rotor 9 and the oil passage hole 2*b* of the camshaft 2 define a central oil passage 36 around the shaft of the center bolt 15. The central oil passage 36 is communicated with the advance main oil passage 39 through the introduction oil passage 37 and the oil passage hole 2*b* within the camshaft 2. Also, the central oil passage 36 is communicated with advance distribution passages 33, 34, 35 within the rotor body part 9*d*. More specifically, the advance distribution passage 33 is communicated with the advance hydraulic chamber 63, the advance distribution passage 34 is communicated with the advance hydraulic chamber 64, and the advance distribution passage 35 is communicated with the advance hydraulic chamber 65.

The camshaft 2 has a journal part 42 that is rotatably supported by a bearing part 41 formed at a cylinder head (not shown). The journal part 42 is limited from being displaced in rotational axis direction. The retard main oil passage 38 and the advance main oil passage 39 are both communicated with the introduction oil passage 28 and the oil passage hole 2*b* within the camshaft 2 through a passage (not shown) within the bearing part 41.

A switching valve 49 has two ports on a side toward an oil pan 45. One port of the switching valve 49 is connected with a pumping oil passage 47, through which pressurized oil from an oil pump 46 is pumped. The other port of the switching valve 49 is connected with a draining oil passage 48, through which oil is drained to the oil pan 45. Also, the switching valve 49 has further two ports on the other side toward the valve timing adjuster 99. One port is connected with the retard main oil passage 38, and the other port is connected with the advance main oil passage 39.

The switching valve 49 is capable of switching the operation between the following three modes 49*a* to 49*c*.

(A) Retard-Feed Mode 49*a*: The switching valve 49 provides communication between the pumping oil passage 47 and the retard main oil passage 38, and provides communication between the draining oil passage 48 and the advance main oil passage 39.

(B) Stop Mode 49*b*: The switching valve 49 is prevented from providing any communication.

(C) Advance-Feed Mode 49*c*: The switching valve 49 provides communication between the pumping oil passage 47 and the advance main oil passage 39, and provides communication between the draining oil passage 48 and the retard main oil passage 38.

Due to the above configuration, switching operation of the switching valve 49 enables the supply of pressurized oil from the oil pump 46 selectively to (a) the retard hydraulic chambers 60, 61, 62 and the hydraulic chamber 23 or (b) the advance hydraulic chambers 63, 64, 65 and the hydraulic chamber 24. Also, the switching operation enables the stopping of the supply to any of the chambers.

(Operation)

Next, the operation of the valve timing adjuster 99 will be described. In the present embodiment, the operation in the advance direction is referred to as "advance operation", and the operation in the retard direction is referred to as "retard operation".

(1) As shown in FIG. 3, in an initial state, such as at the time of engine start, where pressurized oil supplied from the pump 46 has not been introduced into any of the retard hydraulic chambers 60, 61, 62 and the advance hydraulic chambers 63, 64, 65, the vane rotor 9 is located at the full retard position.

The stopper pin 70 is fitted with the stopper ring 74 by the biasing force of the spring 72, and the vane rotor 9 is engaged with the gear 1 through the stopper pin 70.

(2) In the advance operation, when the switching valve 49 is selectively operated in the advance-feed mode 49*c*, pressurized oil from the oil pump 46 is pumped into the central oil passage 36 through the pumping oil passage 47, the advance main oil passage 39, and the introduction oil passage 37.

Then, pressurized oil is distributed from the central oil passage 36 to the advance hydraulic chambers 63, 64, 65 through the advance distribution passages 33, 34, 35. Also, pressurized oil is distributed to the hydraulic chamber 24 through the communication hole 26.

Because the stopper pin 70 receives oil pressure of the hydraulic chamber 24 by the end portion of the stopper pin 70, the stopper pin 70 is further pushed into the receiving hole 71 toward the bottom portion against the biasing force of the spring 72. Thereby, the stopper pin 70 is disengaged from the stopper ring 74, and the vane rotor 9 is decoupled from the gear 1.

Because the vane rotor 9 also receives oil pressure in the advance hydraulic chambers 63, 64, 65 by the retard-side surfaces of the respective vane parts 9*a*, 9*b*, 9*c*, the vane rotor 9 is rotationally moved in the advance direction. Thus, as shown in FIG. 4, the vane rotor 9 is rotationally movable up to the full advance position to the full.

As above, valve timing of the camshaft 2 is advanced. Also, pressurized oil in the retard hydraulic chambers 60, 61, 62 is drained to the oil pan 45 through the annular oil passage 29, the introduction oil passage 28, the retard main oil passage 38, and the draining oil passage 48.

When the vane rotor 9 is rotationally moved, the vane parts 9*a*, 9*b*, 9*c* are displaced from positions shown in FIG. 5 to positions shown in FIG. 6 while the vane parts 9*a*, 9*b*, 9*c* contact the respective resilient parts 55. During the above rotational movement, pressure in the advance hydraulic chamber 65 remains relatively high, and pressure in the retard hydraulic chambers 60, 61, 62 remains relatively low.

In the above state, the pressurized oil introduction passages 53 of the seal plate 50 are not covered by the vane parts 9*a*, 9*b*, 9*c*, but are communicated with the advance hydraulic chambers 63, 64, 65. Thus, pressurized oil in the advance hydraulic chambers 63, 64, 65 are introduced into the pressure chambers 66 through the respective pressurized oil introduction passages 53 as shown by an arrow illustrated by a dashed line in FIGS. 5 and 6. Then, because oil pressure of the pressure chamber 66 is higher than oil pressure in the retard hydraulic chamber 60, 61, 62 located on the side of the resilient part 55 opposite from the pressure chamber 66. As a result, the differential pressure across the resilient part 55 is generated. Thereby, the resilient part 55 is strongly pressed against the respective vane part 9*a*, 9*b*, 9*c*. In FIGS. 5 and 6, directions of arrows indicate the above pressing state. Thereby, it is possible to achieve effective internal leakage sealing performance between the advance hydraulic chambers 63, 64, 65 and the retard hydraulic chambers 60, 61, 62.

(3) Next, in the retard operation, when the switching valve 49 is selectively operated in the retard-feed mode 49*a*, pressurized oil from the oil pump 46 is pumped to the annular oil passage 29 through the pumping oil passage 47, the retard main oil passage 38, and the introduction oil passage 28. Then, pressurized oil is distributed from the annular oil passage 29 to the retard hydraulic chambers 60, 61, 62 through the retard distribution passages 30, 31, 32. Pressurized oil is also distributed to the hydraulic chamber 23 through the communication hole 25.

Because the stopper pin 70 receives oil pressure in the hydraulic chamber 23 at the front side surface of the pressure receiving groove of the stopper pin 70, the stopper pin 70 is further pushed into the receiving hole 71 toward the bottom portion thereof against the biasing force of the spring 72. As a result, the stopper pin 70 is maintained completely disengaged from the stopper ring 74. In other words, the vane rotor 9 is maintained disconnected from the gear 1.

Because oil pressure in the retard hydraulic chambers 60, 61, 62 is also applied to the advance-side surfaces of the vane parts 9*a*, 9*b*, 9*c*, the vane rotor 9 is rotationally moved in the retard direction relative to the gear 1. Thus, the vane rotor 9 is rotationally movable up to the full retard position as shown in FIG. 3 to the full.

As a result, the valve timing of the camshaft 2 is retarded. Also, pressurized oil in the advance hydraulic chambers 63, 64, 65 is drained to the oil pan 45 through the central oil passage 36, the introduction oil passage 37, the advance main oil passage 39, and the draining oil passage 48.

In the above state, pressurized oil introduced from the advance hydraulic chambers 63, 64, 65 remains in the pressure chambers 66. As a result, similar to the advance operation, the differential pressure across the resilient part 55 strongly presses the resilient part 55 against the vane parts 9*a*, 9*b*, 9*c*, and thereby it is possible to effectively achieve the internal leakage sealing performance.

(4) When the switching valve 49 is selectively changed into the stop mode 49*b* while the vane rotor 9 is rotationally moved in the advance direction or in the retard direction, pressurized oil in the retard hydraulic chambers 60, 61, 62 and in the advance hydraulic chambers 63, 64, 65 is prevented from being supplied and discharged, and also, the vane rotor 9 is held at the intermediate position. Thus, it is possible to obtain the desired valve timing.

Through the operational states (1) to (4), the resilient part 55 of the seal plate 50 contacts the wide area of the corresponding end surface of the vane part 9*a*, 9*b*, 9*c* by the resilient force. Furthermore, differential pressure between the pressure chamber 66 and the retard hydraulic chamber 60, 61, 62 is utilized for urging the resilient part 55 to the vane part 9*a*, 9*b*, 9*c*. Thus, it is possible to effectively achieve the internal leakage sealing performance between the advance hydraulic chambers 63, 64, 65 and the retard hydraulic chambers 60, 61, 62. As a result, it is possible to improve the energy efficiency of the oil pump. Also, because it is possible to highly accurately control the relative rotational phase of the vane rotor 9, it is possible to highly accurately obtain the desired valve timing.

Also, because load of the resilient force is not concentrated only on the particular local spot of the seal plate 50, it is possible to improve durability of the seal plate 50.

(Second Embodiment)

In the first embodiment, the initial state corresponds to the full retard position, and the full operational state corresponds to the full advance position. Also, each pressurized oil introduction passage 53 of the seal plate 50 provides communication between the advance hydraulic chamber 63, 64, 65 and the pressure chamber 66. The above state is employed for the valve timing adjuster 99 of the intake valve 90.

In contrast, a valve timing adjuster of the second embodiment is employed for the exhaust valve 93, and opens and closes the exhaust valve 93 by a predetermined phase difference from the crankshaft 97 and the gear 91. As a result, a phase control opposite from the first embodiment is executed. Therefore, in the second embodiment, the initial state corresponds to the full advance position, and the full operational state corresponds to the full retard position. Also, pressurized oil introduction passage of the seal plate provides communication between the respective retard hydraulic chamber and the respective pressure chamber.

(Other Embodiment)

In the above embodiments, the shoe parts 3*a*, 3*b*, 3*c* and the vane parts 9*a*, 9*b*, 9*c* are provided at three positions. However, the shoe parts and the vane parts may be alternatively provided at two position, four positions or more.

The gear 1 is not limited to a sprocket gear that transmits driving force from the crankshaft 97 through the chain 95. However, the gear 1 may be alternatively a pulley that transmits driving force through a belt.

Also, the rotation shaft that is rotatable synchronously with the vane rotor 9 is not limited to the camshaft 2, 92 (driven shaft) of the internal combustion engine 96. However, the rotation shaft may be alternatively the crankshaft 97 that serves as a drive shaft.

The present invention is not limited to the above embodiments. However, the present invention may be employed in various embodiments provided that the various embodiments do not deviate from the scope of the invention.

Additional advantages and modifications will readily occur to those skilled in the art. The invention in its broader terms is therefore not limited to the specific details, representative apparatus, and illustrative examples shown and described.

What is claimed is:

1. A valve timing adjuster mounted to a driving force transmission system that transmits driving force from a drive shaft to a driven shaft, the valve timing adjuster comprising:

a housing member that is rotatable synchronously with one of the drive shaft and the driven shaft;

a vane rotor that is rotatable synchronously with a camshaft, which is the other one of the drive shaft and the driven shaft, and which opens and closes at least one of an intake valve and an exhaust valve, wherein:

the vane rotor includes a plurality of vane parts, each of which is movable rotatably relative to the housing member within a predetermined angular range;

each of the plurality of vane parts defines an advance hydraulic chamber on one rotational side of each of the plurality of the vane parts;

each of the plurality of vane parts defines a retard hydraulic chamber on the other rotational side of each of the plurality of the vane parts; and the housing member includes:

a first housing segment receiving the vane rotor therein; and a second housing segment facing an opening of the first housing segment, the second housing segment covering an end surface of the vane rotor, the valve timing adjuster further comprising:

a seal plate provided between the end surface of the vane rotor and the second housing segment, the seal plate being held by the first housing segment and the second housing segment therebetween, wherein:

the seal plate includes:

a base part that is held by the first housing segment and the second housing segment therebetween; and a resilient part that is in press-contact with the end surface of the vane rotor within a range that corresponds to the predetermined angular range, the resilient part of the seal plate projects from the base part toward the end surface of the vane rotor; and the resilient part has:

an upper surface part that is in press-contact with the end surface of the vane rotor the upper surface part having a flat surface the upper surface part being displaced from the base part in a longitudinal direction of the camshaft; and a slanted part that connects the base part with the upper surface part, the slanted part being angled relative to the upper surface part and the base part;

the resilient part, an end surface of the second housing segment, and an outer peripheral surface of the camshaft define therebetween a pressure chamber;

the resilient part has a pressurized oil introduction passage that provides communication between the pressure chamber and only one of the advance hydraulic chamber and the retard hydraulic chamber; and the pressure chamber is closed by the resilient part, the end surface of the second housing segment and the outer peripheral surface of the camshaft, except for the pressurized oil introduction passage.

2. The valve timing adjuster according to claim 1, wherein:

the slanted part has the pressurized oil introduction passage.

3. The valve timing adjuster according to claim 1, wherein:

the camshaft causes the intake valve to be opened or closed; and the pressurized oil introduction passage provides communication of the pressure chamber only with the advance hydraulic chamber.

4. The valve timing adjuster according to claim 1, wherein:

the camshaft causes the exhaust valve to be opened or closed; and the pressurized oil introduction passage provides communication of the pressure chamber only with the retard hydraulic chamber.

* * * * *